US010059490B2

(12) United States Patent
Schuetz

(10) Patent No.: US 10,059,490 B2
(45) Date of Patent: Aug. 28, 2018

(54) BUNG STOPPER CLOSURE FOR BUNG-TYPE CONTAINER

(71) Applicant: Udo Schuetz, Selters (DE)

(72) Inventor: Udo Schuetz, Selters (DE)

( * ) Notice: Subject to any disclaimer, the term of this patent is extended or adjusted under 35 U.S.C. 154(b) by 0 days.

(21) Appl. No.: 15/412,602

(22) Filed: Jan. 23, 2017

(65) Prior Publication Data

US 2017/0152077 A1 Jun. 1, 2017

Related U.S. Application Data

(63) Continuation of application No. 12/787,458, filed on May 26, 2010, now abandoned.

(51) Int. Cl.

| | |
|---|---|
| ***B65D 39/08*** | (2006.01) |
| ***B65D 41/48*** | (2006.01) |
| ***B65D 55/02*** | (2006.01) |
| ***B65D 55/08*** | (2006.01) |

(52) U.S. Cl.

CPC ..... *B65D 39/088* (2013.01); *B65D 41/48* (2013.01); *B65D 55/024* (2013.01); *B65D 55/0863* (2013.01)

(58) Field of Classification Search

CPC .. B65D 39/088; B65D 55/0863; B65D 41/48; B65D 55/024

USPC ..... 220/787

See application file for complete search history.

(56) References Cited

U.S. PATENT DOCUMENTS 4,883,194 A * 11/1989 Fernandes ..... B65D 39/08 220/296

6,726,048 B2 * 4/2004 Dwinell ..... B65D 39/08 220/212

FOREIGN PATENT DOCUMENTS

WO WO 2008139196 A1 * 11/2008 ..... B65D 39/08

* cited by examiner

*Primary Examiner* — James N Smalley

(74) *Attorney, Agent, or Firm* — Quarles & Brady LLP

(57) ABSTRACT

A bung stopper closure includes a bung stopper and a sealing cap for bung-type containers, which is particularly suitable for machine closing of bung-type barrels in automatic filling plants for liquids.

13 Claims, 4 Drawing Sheets

BUNG STOPPER CLOSURE FOR BUNG-TYPE CONTAINER

CROSS-REFERENCE TO RELATED APPLICATION

This application is a continuation of U.S. patent application Ser. No. 12/787,458 filed on May 26, 2010, and claims the priority benefit of German Patent Application No. 10 2009 022 800.4 filed on May 27, 2009, the contents of which are hereby incorporated by reference as if fully set forth herein in their entirety.

STATEMENT CONCERNING FEDERALLY SPONSORED RESEARCH OR DEVELOPMENT

Not applicable.

FIELD OF THE INVENTION

The invention relates to a bung stopper closure for bung-type containers, in particular for bung-type barrels made of plastic for liquids, having a bung stopper made of plastic or metal, which can be screwed into a bung connecting piece of the container implemented as a threaded connecting piece, and a sealing cap made of plastic, which can be snapped onto the bung stopper, for detecting manipulations, the cup-shaped bung stopper having a cylindrical outer wall having an external thread, on whose internal circumference socket engagement eyes for a socket are situated concentrically to the stopper central axis, which extend radially and axially in the stopper depression of the bung stopper.

BACKGROUND OF THE INVENTION

The sealing cap of a bung stopper closure of the type according to the species, which is described in EP 1 697 224 B1, for bung-type containers has elastic legs, which extend axially in the stopper depression and have a radially protruding foot. When the sealing cap is snapped onto the bung stopper, which is screwed into the bung connecting piece of a bung-type container, the elastic legs of the sealing cap plunge into the stopper depression and the leg feet lock with radial undercuts, which are formed on the base of the socket engagement eyes. The external diameter of the circularly situated leg feet of the sealing cap is greater than the internal diameter of the circularly situated, outwardly curved inner walls of the socket engagement eyes of the bung stopper having the undercuts for locking the leg feet of the sealing cap. This geometry of the closure stopper and the sealing cap results in difficulties when snapping the sealing cap onto the closure stopper in automatic filling plants for liquids, because the catch feet of the elastic legs of the sealing cap hit the upper edge of the socket engagement eyes of the bung stopper of the container to be closed at the beginning of the snapping procedure and are not guided by the inner walls of the socket engagement eyes of the bung stopper, but rather must be compressed far enough that the catch feet may engage with the inner walls of the socket engagement eyes.

SUMMARY OF THE INVENTION

The invention is based on the object of developing a bung stopper closure which is suitable for automatic filling plants for bung-type containers, in particular bung-type barrels.

This object is achieved in one embodiment of the invention by a bung stopper closure for bung-type containers, as described herein.

This and still other objectives and advantages of the present invention will be apparent from the description which follows. In the detailed description below, preferred embodiments of the invention will be described in reference to the accompanying drawings. These embodiments do not represent the full scope of the invention. Rather the invention may be employed in other embodiments. Reference should therefore be made to the claims herein for interpreting the breadth of the invention.

BRIEF DESCRIPTION OF THE DRAWINGS

The invention is explained hereafter on the basis of the figures of the drawing. In the figures.

DETAILED DESCRIPTION OF THE EXAMPLE EMBODIMENTS

Figure 1:
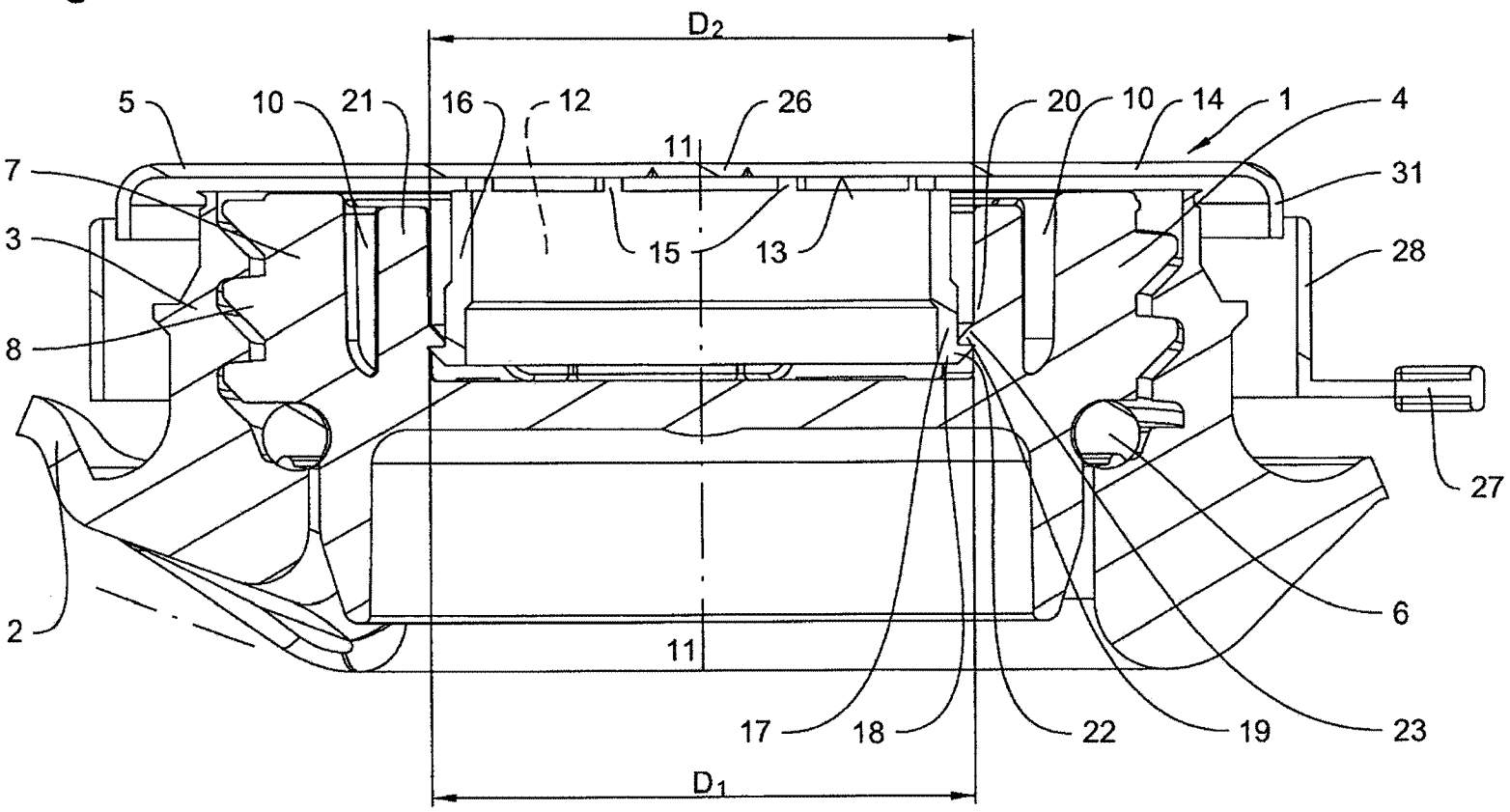
FIG. 1 shows a longitudinal section of a first embodiment of a bung stopper closure for a bung-type container.
Figure 2:
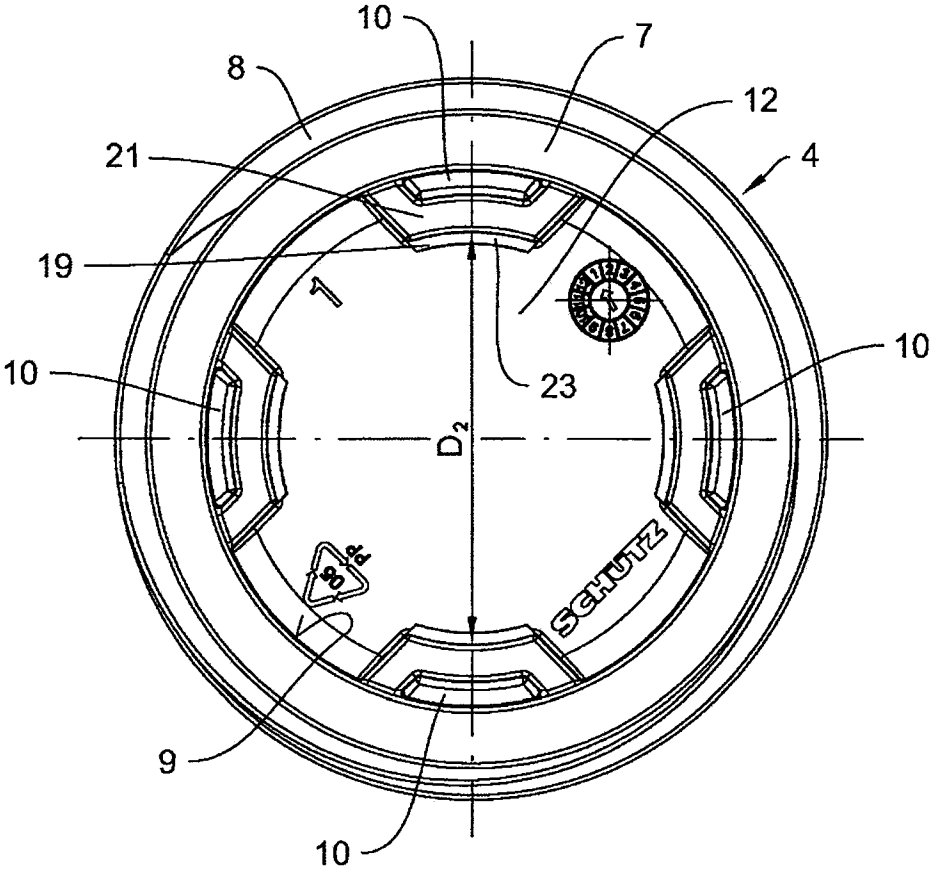
FIG. 2 shows the top view of the bung stopper.
Figure 3:
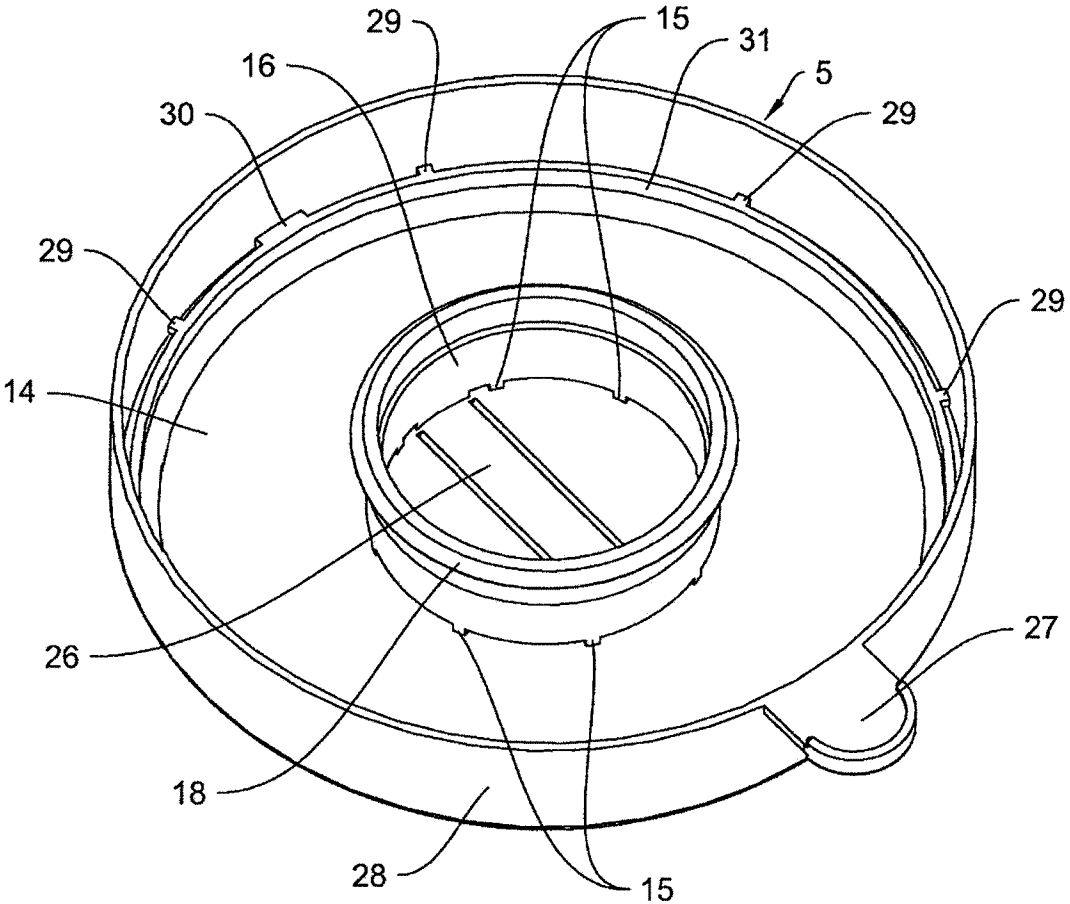
FIG. 3 shows a perspective internal view of the sealing cap of the bung stopper.

The bung stopper closure 1 according to FIGS. 1 through 3 for bung-type containers 2 made of plastic such as bung-type barrels is formed by a bung connecting piece 3, implemented as a threaded connecting piece, of the container 2, a bung stopper 4 made of plastic or metal, which can be screwed into the bung connecting piece 3, and a sealing cap 5 made of plastic, which can be snapped onto the bung stopper 4, for the detection of manipulations. The bung stopper 4 is sealed in the bung connecting piece 3 using a sealing ring 6.

The cup-shaped bung stopper 4 has a cylindrical outer wall 7 having an external thread 8, on whose internal circumference 9 socket engagement eyes 10 for a socket, which extend radially and axially in the stopper depression 12 of the bung stopper 4, are situated concentrically to the stopper central axis 11-11.

A concentric, delimited elastic clamping sleeve 16 is attached on the inner side 13 of the sealing cap disc 14 using tear-off webs 15, which extend axially into the stopper depression 12 and have an annular detent element 18 protruding radially into the stopper depression 12 on their inner and 17, for locking with counter detent elements 19, which are in the form of ring segments and protrude radially into the stopper depression 12, on the lower section 20 of the outwardly curved inner walls 21, in the form of cylinder segments, of the socket engagement eyes 10.

The annular detent element 18 of the clamping sleeve 16 of the sealing cap 5 and the counter detent elements 19, in the form of ring segments, on the socket engagement eyes 10 of the bung stopper 4 have hooked cross-sectional profiles 22, 23.

The external diameter $D_1$ of the annular detent element 18 on the clamping sleeve 16 of the sealing cap 5 is approximately equal to the diameter $D_2$ of the inner walls 21 of the socket engagement eyes 10 of the bung stopper 4, in such a way that when the sealing cap 5 is snapped onto the bung stopper 4, which is screwed into the bung connecting piece 3, the annular detent element 18 at the inner end 17 of the clamping sleeve 16 of the sealing cap 5 is guided by the inner walls 21 of the socket engagement eyes 10 before locking with the counter detent elements 19 on the inner walls 21 of the socket engagement eyes 10 of the bung stopper 4.

This mode of operation of sealing cap 5 and bung stopper 4 when the sealing cap is snapped onto the bung stopper allows machine closing of the bung connecting piece 3 of bung-type containers 2 in automatic filling plants, in particular for bung-type barrels.

In a further embodiment (not shown) of the bung stopper closure, the annular detent element 18 on the inner end 17 of the clamping sleeve 16 of the sealing cap 5 and the counter detent elements 19 in the form of ring segments on the socket engagement eyes 10 of the bung stopper 4 have a tongue-shaped cross-sectional profile.

Figure 4:
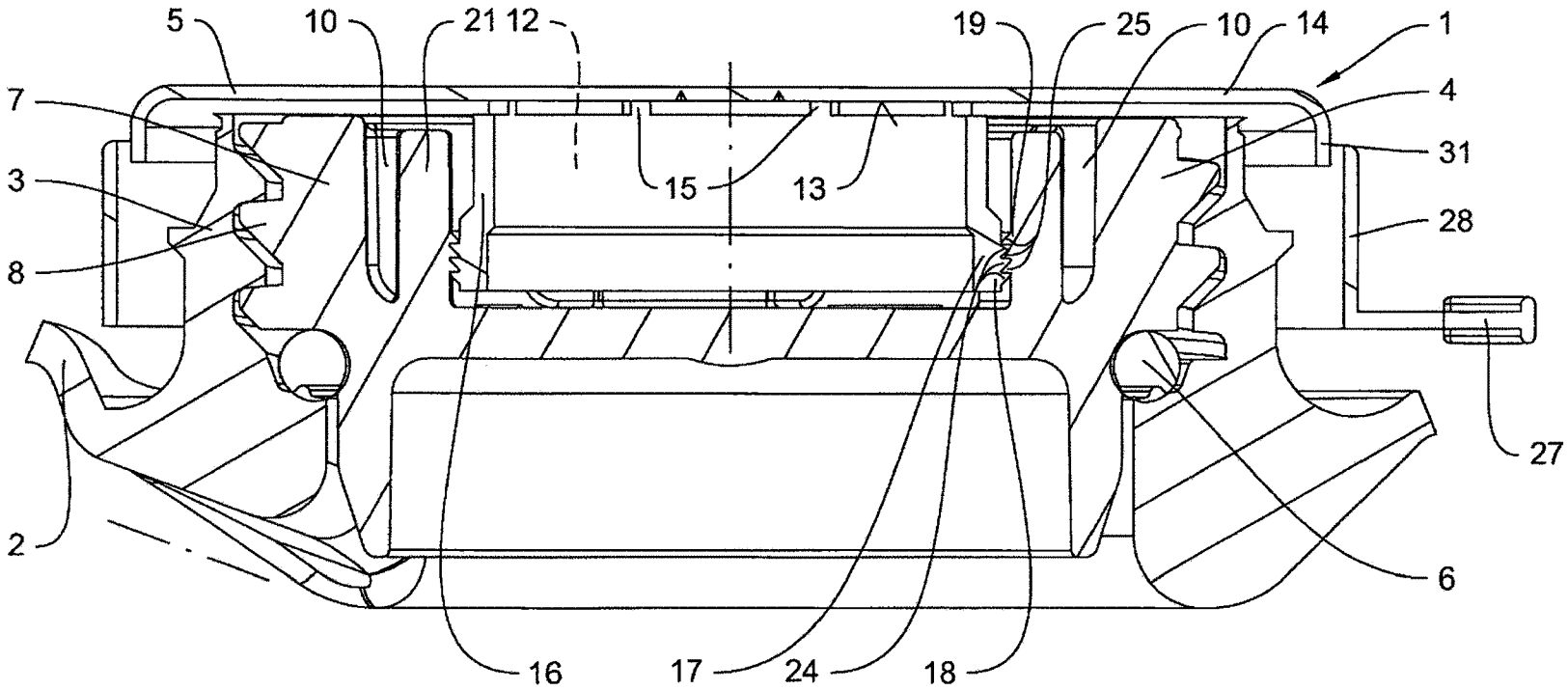
FIG. 4 shows a longitudinal section of a second embodiment of the bung stopper closure.

In the further embodiment of the bung stopper closure 1 shown in FIG. 4, the annular detent element 18 on the inner end 17 of the clamping sleeve 16 of the sealing cap 5 is preferably equipped with three toothed rings 24 for locking with three corresponding toothed ring segments 25 of the counter detent elements 19 on the socket engagement eyes 10 of the bung stopper 4.

The clamping sleeve 16 of the sealing cap 5 is connected by a tear-off tab 26 to the sealing cap disc 14 in addition to the tear-off webs 15, the tear-off tab 26 being integrated in the sealing cap disc 14.

The sealing cap 5 is equipped with an outer tear-off tab 27, which is molded onto a tear-off ring 28, which is attached by tear-off webs 29 and a retention web 30 to the downwardly-directed outer edge 31 of the sealing cap 5.

When the sealing cap 5 is torn off of the bung stopper 4 using the tear-off tab 27, firstly the tear-off webs 29 of the tear-off ring 28 of the tear-off tab 27 are destroyed and then the tear-off webs 15, using which the clamping sleeve 16 is attached to the sealing cap disc 14, are broken. During this tear-off procedure, the retention web 30 of the tear-off ring 28 of the tear-off tab 27 and the tear-off tab 26, which is integrated in the sealing cap disc 14 and is connected to the clamping sleeve 16, ensure that the tear-off ring 28 having the tear-off tab 27, the sealing cap disc 14 and the clamping sleeve 16 of the sealing cap 5 remain loosely connected to one another and thus the sealing cap 5 can be removed easily with its individual components from the bung stopper 4.

LIST OF REFERENCE NUMERALS

1 bung stopper closure
2 bung-type container
3 bung connecting piece
4 bung stopper
5 sealing cap
6 sealing ring
7 outer wall of 4
8 external thread on 7
9 internal circumference of 7
10 socket engagement eyes on 9
11-11 stopper central axis
12 stopper depression
13 inner side of 14
14 sealing cap disc
15 tear-off web of 16 on 13
16 clamping sleeve
17 inner end of 16
18 detent element on 17
19 counter detent element on 20
20 lower section on 21
21 inner wall of 10
22 hooked cross-sectional profile of 18
23 hooked cross-sectional profile of 19
24 toothed ring on 18
25 toothed ring segment on 10
26 tear-off tab for 16 in 14
27 tear-off tab of 5
28 tear-off ring of 27
29 tear-off web of 28
30 retention web of 28
31 outer edge of 5
$D_1$ external diameter of 18 on 16
$D_2$ diameter of 21 of 10

The invention claimed is:

1. A bung stopper closure for bung-type containers, in particular for bung-type barrels made of plastic for liquids, said bung stopper closure comprising:

a cup-shaped bung stopper made of plastic or metal, which can be screwed into a bung connecting piece of the container, implemented as a threaded connecting piece, and a sealing cap made of plastic, which can be snapped onto the bung stopper, for detection of manipulations, the bung stopper having a cylindrical outer wall having an external thread, on whose internal circumference socket engagement eyes for a socket are situated concentrically to the stopper central axis, which extend radially and axially in a stopper depression of the bung stopper, said sealing cap including a central, delimited elastic clamping sleeve, attached using tear-off webs to an inner side of a sealing cap disc, which extends axially in a stopper depression and has an annular detent element on its inner end protruding radially into the stopper depression for locking with counter detent elements, which are in the form of ring segments and protrude radially into the stopper depression which protruding ring segments being arranged at the lower end of outwardly curved inner walls of the socket engagement eyes, which inner walls having the form of cylinder segments and which ring segments protrude beyond the inner wall, an external diameter of the annular detent element on the clamping sleeve of the sealing cap being approximately equal to a diameter of the inner walls of the socket engagement eyes of the bung stopper in such a manner that when the sealing cap is snapped onto the bung stopper, which is screwed into a bung connecting piece, the annular detent element on the inner end of the clamping sleeve of the sealing cap is guided by the inner walls of the socket engagement eyes before locking with the counter detent elements on the inner walls of the socket engagement eyes of the bung stopper.

2. The bung stopper closure according to claim 1, in which the annular detent element on the inner end of the clamping sleeve of the sealing cap and the counter detent elements in the form of ring segments on the socket engagement eyes of the bung stopper have hooked cross-sectional profiles.

3. The bung stopper closure according to claim 1, in which the annular detent element on the inner end of the clamping sleeve of the sealing cap and the counter detent elements in the form of ring segments on the socket engagement eyes of the bung stopper have a tongue-shaped cross-sectional profile.

4. The bung stopper closure according to claim 1, in which the annular detent element on the inner end of the clamping sleeve of the sealing cap is equipped with multiple toothed rings for locking with corresponding toothed ring segments of the counter detent elements on the socket engagement eyes of the bung stopper.

5. The bung stopper closure according to claim 1, in which the clamping sleeve of the sealing cap is connected to the sealing cap disc via tear-off webs and a tear-off tab, which is integrated in the sealing cap disc.

6. The bung stopper closure according to claim 1, including an outer tear-off tab, which is molded onto a tear-off ring, and which is attached by tear-off webs and a retention web to a downwardly directed outer edge of the sealing cap.

7. A bung stopper closure for bung-type containers, in particular for bung-type barrels made of plastic for liquids, said bung stopper closure comprising:

a bung stopper having a stopper depression and a cylindrical outer wall having an external thread threadably engageable with a threaded connecting piece of a bung connecting piece of the container, said bung stopper having socket engagement eyes situated concentrically to a stopper central axis on an internal circumference of the outer wall and extending radially and axially in the stopper depression of the bung stopper, said socket engagement eyes including curved inner walls defining a diameter ($D_2$);

a sealing cap snapped onto the bung stopper, said sealing cap including a sealing cap disc and a central elastic clamping sleeve attached to said sealing cap disc by tear-off webs, said sleeve extending axially into the stopper depression and having an annular detent element protruding radially into the stopper depression; and a counter detent element in the form of at least one ring segment protruding radially into the stopper depression from a lower end of the curved inner walls of the socket engagement eyes lock with said annular detent element, the inner walls having the form of cylinder segments with the ring segments protruding beyond the inner walls, wherein an external diameter ($D_1$) of the annular detent element on the clamping sleeve of the sealing cap being approximately equal to the diameter ($D_2$) of the inner walls of the socket engagement eyes of the bung stopper in such a manner that when the sealing cap is snapped onto the bung stopper, which is screwed into the bung connecting piece, the annular detent element on the inner end of the clamping sleeve of the sealing cap is guided by the inner walls of the socket engagement eyes before locking with the counter detent elements on the inner walls of the socket engagement eyes of the bung stopper.

8. The bung stopper closure according to claim 7, in which the annular detent element on the inner end of the clamping sleeve of the sealing cap and the counter detent elements in the form of ring segments on the socket engagement eyes of the bung stopper have hooked cross-sectional profiles.

9. The bung stopper closure according to claim 7, in which the annular detent element on the inner end of the clamping sleeve of the sealing cap and the counter detent elements in the form of ring segments on the socket engagement eyes of the bung stopper have a tongue-shaped cross-sectional profile.

10. The bung stopper closure according to claim 7, in which the annular detent element on the inner end of the clamping sleeve of the sealing cap is equipped with multiple toothed rings for locking with corresponding toothed ring segments of the counter detent elements on the socket engagement eyes of the bung stopper.

11. The bung stopper closure according to claim 7, in which the clamping sleeve of the sealing cap is connected to the sealing cap disc via tear-off webs and a tear-off tab, which is integrated in the sealing cap disc.

12. The bung stopper closure according to claim 7, including an outer tear-off tab, which is molded onto a tear-off ring, and which is attached by tear-off webs and a retention web to a downwardly directed outer edge of the sealing cap.

13. The bung stopper closure according to claim 1, wherein the ring segment forming the counter detent element extends radially into the stopper depression between a first distance offset from a bottom surface of the stopper depression and a second distance offset from a top surface of the stop depression.

* * * * *